US008770089B2

(12) United States Patent
Zakharov

(10) Patent No.: US 8,770,089 B2
(45) Date of Patent: Jul. 8, 2014

(54) CRANKSHAFT-LINK PISTON MACHINE

(76) Inventor: Evgeny Nikolaevich Zakharov, Moscovskaya oblast (RU)

( * ) Notice: Subject to any disclaimer, the term of this patent is extended or adjusted under 35 U.S.C. 154(b) by 718 days.

(21) Appl. No.: 12/998,366

(22) PCT Filed: Oct. 13, 2009

(86) PCT No.: PCT/RU2009/000542
§ 371 (c)(1),
(2), (4) Date: Apr. 13, 2011

(87) PCT Pub. No.: WO2010/044707
PCT Pub. Date: Apr. 22, 2010

(65) Prior Publication Data
US 2011/0197754 A1 Aug. 18, 2011

(30) Foreign Application Priority Data
Oct. 14, 2008 (RU) ..... 2008140447

(51) Int. Cl.
*F01B 9/00* (2006.01)
*F16H 21/16* (2006.01)

(52) U.S. Cl.
USPC ..... 92/140; 92/129; 74/49; 123/197.1

(58) Field of Classification Search
CPC ..... F01B 9/00; F01B 9/02; F01B 9/047; F02B 75/32; F16D 3/16; F16J 1/10; F16J 1/20; F16H 21/16; F16H 21/30
USPC ..... 92/72, 129, 136, 140; 74/49; 123/52.1, 123/53.6, 197.1, 197.2, 197.4
See application file for complete search history.

(56) References Cited

U.S. PATENT DOCUMENTS

| | | | | |
|---|---|---|---|---|
| 2,312,057 | A * | 2/1943 | Williams | 74/49 |
| 4,395,977 | A * | 8/1983 | Pahis | 123/197.4 |
| 4,534,272 | A * | 8/1985 | Irwin | 91/493 |
| 5,479,894 | A | 1/1996 | Noltemeyer et al. | |
| 6,119,640 | A * | 9/2000 | Zakharov et al. | 123/54.2 |
| 6,131,544 | A * | 10/2000 | Zakharov et al. | 123/197.3 |
| 6,601,551 | B1 | 8/2003 | Rabhi | |
| 7,013,849 | B2 * | 3/2006 | Rabhi | 123/48 B |
| 7,878,081 | B2 * | 2/2011 | Sundheim | 92/72 |
| 8,424,400 | B2 * | 4/2013 | Zakharov | 74/25 |
| 2010/0258082 | A1 * | 10/2010 | Ryan | 123/44 E |

FOREIGN PATENT DOCUMENTS

| | | |
|---|---|---|
| RU | 2 029 190 | 2/1995 |
| RU | 2 103 533 | 1/1998 |

OTHER PUBLICATIONS

International Search Report.

* cited by examiner

*Primary Examiner* — Thomas E Lazo
(74) *Attorney, Agent, or Firm* — Collard & Roe, P.C.

(57) ABSTRACT

The invention relates to mechanical engineering, in particular to piston machines and mechanisms for converting the movement of the pistons thereof into shaft rotation. The technical result of the invention involves increasing the operational reliability, extending the service life, improving the specific mass and dimensional characteristics and enhancing the effectiveness of a machine. The essence of the invention is that the piston and the crank of a piston machine are interconnected by means of a hinged joint with at least a flat hinge which enables the piston to self-center along the surface of a cylinder owing to the movement of the piston with respect to the crank in any direction on a plane that intersects the longitudinal axis of the cylinder. The surfaces of the crank that take up reactive torque are constricted by rollers with synchronized toothed wheels.

6 Claims, 8 Drawing Sheets

CRANKSHAFT-LINK PISTON MACHINE

CROSS REFERENCE TO RELATED APPLICATIONS

This application is the National Stage of PCT/RU2009/000542 filed on Oct. 13, 2009, which claims priority under 35 U.S.C. §119 of Russian Application No. 2008140447 filed on Oct. 14, 2008, the disclosure of which is incorporated by reference. The international application under PCT article 21(2) was not published in English.

FIELD OF THE INVENTION

The invention relates to the sphere of machine building, in particular to the piston machines and mechanisms converting piston reciprocation into shaft rotation.

BACKGROUND ART

As is known there exists a crankshaft-link piston machine consisting of a case accommodating a crankshaft with one crank which mounts, through a bearing, a slide block; the opposite work surfaces of the slide block interact with the surfaces of the link coupled with a piston reciprocating inside a cylinder secured to the machine case (Ref. Artobolevsky, *Mechanisms in Current Technology*, Moscow, Nauka, Volume 2, p. 23, 1979).

The disadvantages of the known machine are considerable radial dimensions of the machine (in the direction of the cylinder axis) due to allocation of separate successive zones: for movement of the link having a considerable width, for the rod guide and for the piston motion (cylinder). Besides, the rod and its guide possess insufficient rigidity to take up the reactive torque of the machine, and sliding friction in this assembly results in substantial mechanical losses.

As is known there exists a crankshaft-link piston machine consisting of a case accommodating a crankshaft with one crank which mounts, through a bearing, a slide block; the opposite work surfaces of the slide block interact with the surfaces of the link coupled with a piston reciprocating inside a cylinder secured to the machine case (Ref. RF Patent No. 2103533, published on Jan. 27, 1998).

In the known machine the assemblies translating the reactive torque are located directly on the link frame, which increases the structural rigidity but requires a rather extended contact surface to take up the reactive torque and match the spatial position of the said contact surfaces with that of the piston. Besides, during rolling of guide rollers, sliding of the sliding elements takes place both in the bearing proper and when the bearing slips relative to the contact surface, which decreases the machine reliability and life.

SUMMARY OF THE INVENTION

The technical result of the claimed invention consists in the increased operational reliability of the machine, extended life, optimized weight and size parameters and higher efficiency.

According to the invention, the claimed objective is achieved by the fact that in the crankshaft-link piston machine consisting of a case accommodating a crankshaft with at least one crank which mounts, through a bearing, a slide block (slider), where the opposite work surfaces of the slide block interact with the surfaces of the link coupled with at least on piston reciprocating inside a cylinder secured to the machine case, the piston and link are interconnected by a hinge assembly incorporating, as a minimum, a flat hinge, which enables the piston to self-align along the cylinder surface due to its travel relative to the link in any direction in the plane crossing the cylinder longitudinal axis, while the interfacing surfaces of the link and case taking up the reactive torque bear side support elements with contact surfaces and toothed racks and the space between the contact surfaces of the side support elements accommodate rollers provided with synchronizing toothed wheels which are engaged with the toothed racks of the side support elements, where at least two rollers are mounted on each side of the link, therewith the support elements and rollers are installed with preliminary constriction of interfacing contact surfaces and rollers.

The claimed objective is also achieved by the fact that the hinge assembly may be additionally equipped with a spherical hinge, enabling the piston to change the tilt angle of its longitudinal axis relative to the link reciprocation direction.

The claimed objective is also achieved by the fact that it may contain a mechanism constraining the side support elements to create a pre-interference in the place where the rollers are engaged with the contact surfaces of the side support elements.

The claimed objective is also achieved by the fact that the support elements mounted on the case may be equipped with an adjustment mechanism.

The claimed objective is also achieved by the fact that operating support elements with contact surfaces and toothed racks may be installed on the interfacing surfaces of the slide block and link, while the space between the contact surfaces of the slide block and link accommodates support rollers provided with synchronizing toothed wheels which are engaged with the racks of the operating support elements of the link and slide block. Therewith, at least one operating support element may contain a mechanism for adjusting its spatial position to create at least a pre-interference in the place where the rollers are engaged with the contact surfaces of the operating support elements.

THE BEST EMBODIMENT OF THE INVENTION

Figure 1:
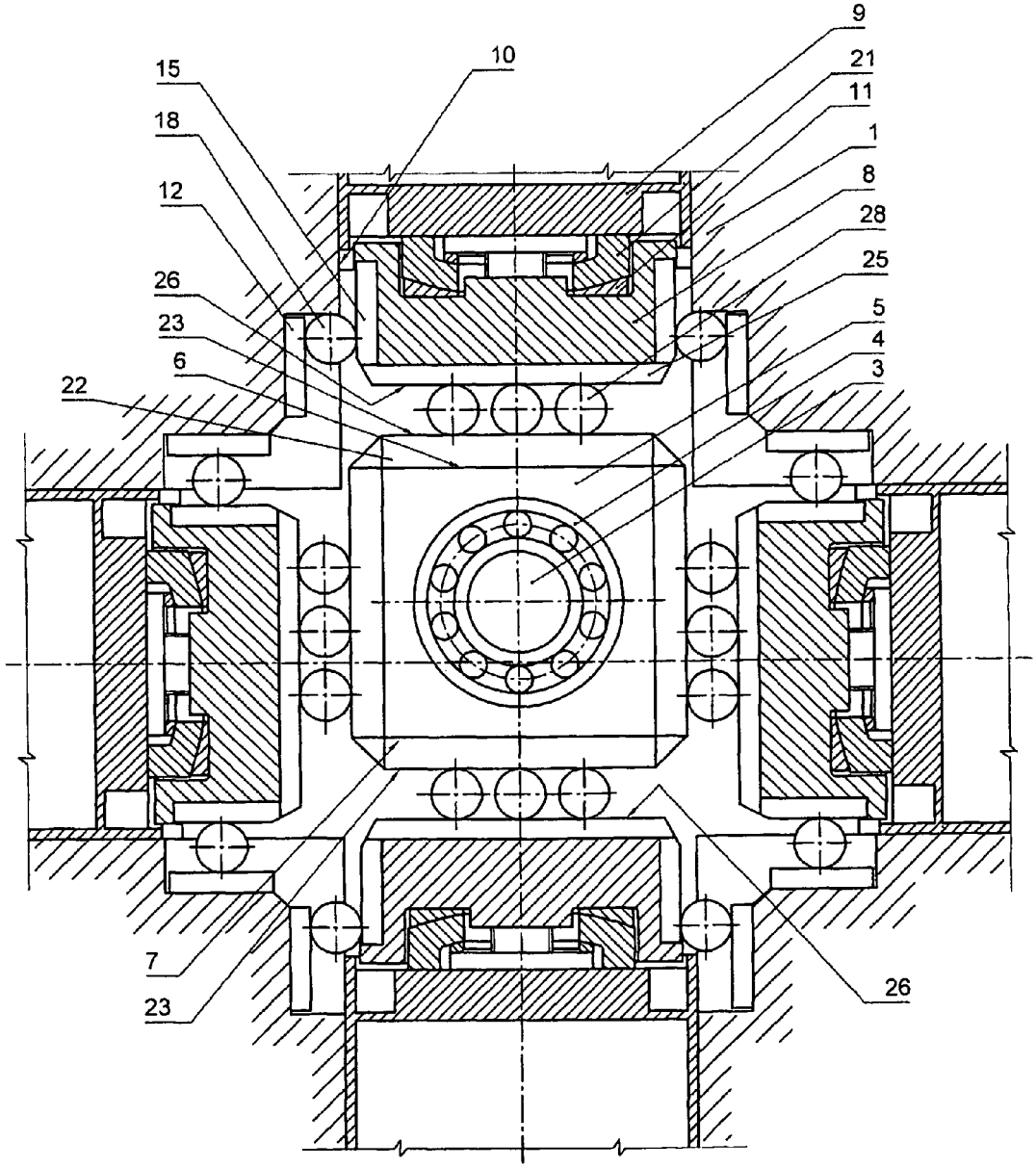
FIG. 1 shows a four-cylinder variant of the crankshaft-link piston machine.
Figure 2:
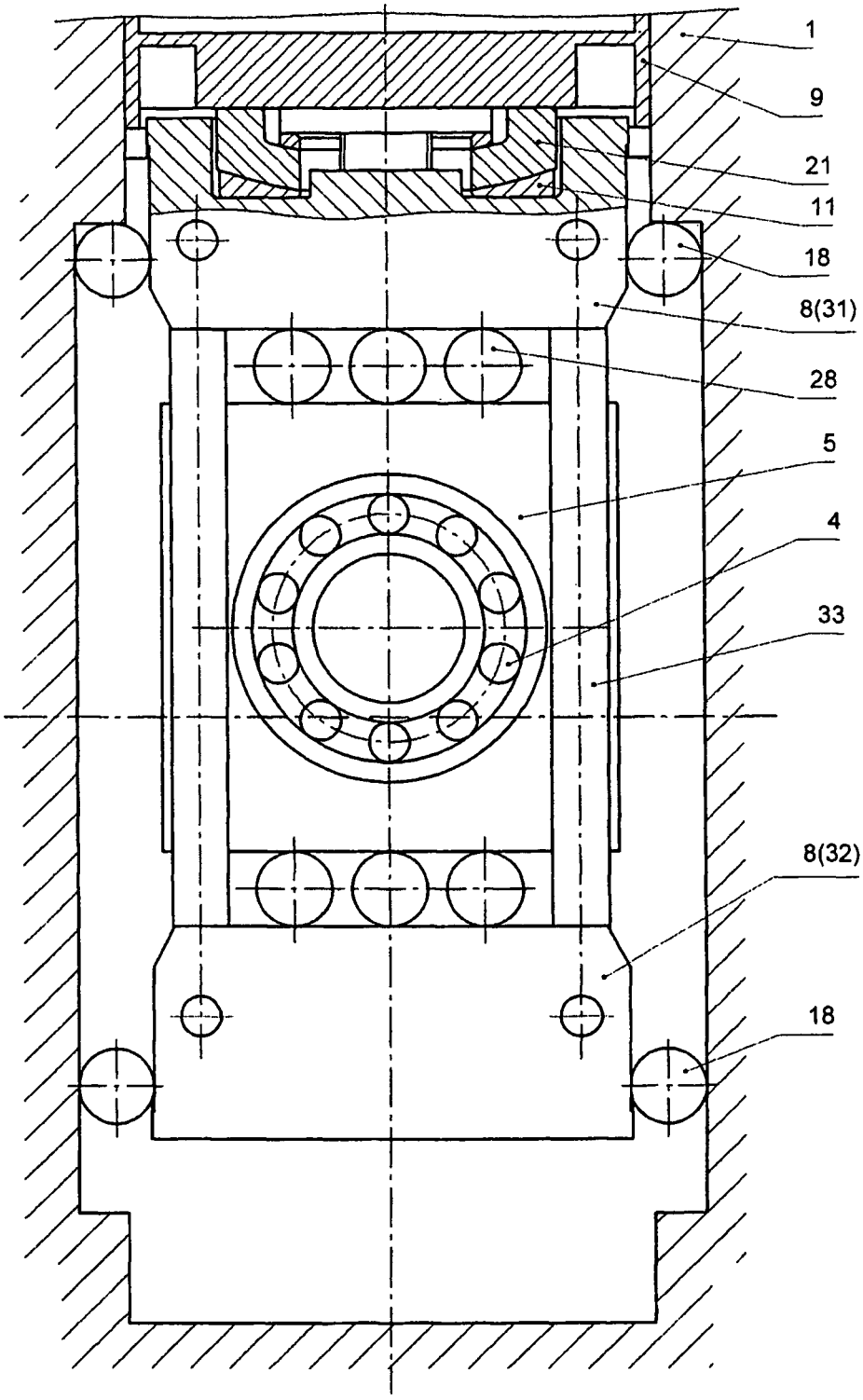
FIG. 2 shows the drawing of a one-cylinder machine with side rollers located on the opposite parts of the link.
Figure 3:
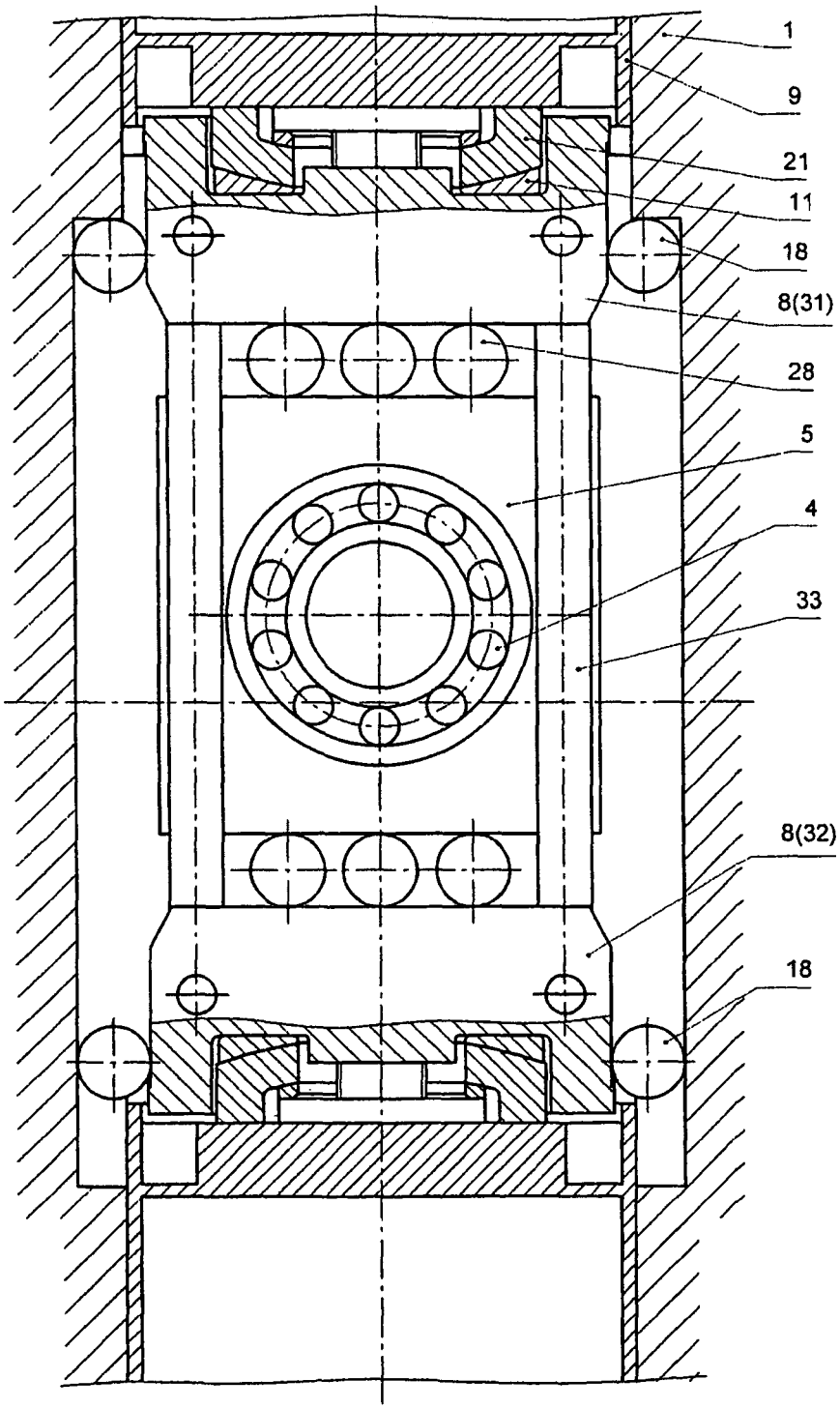
FIG. 3 shows the same, a two-cylinder machine.
Figure 4:
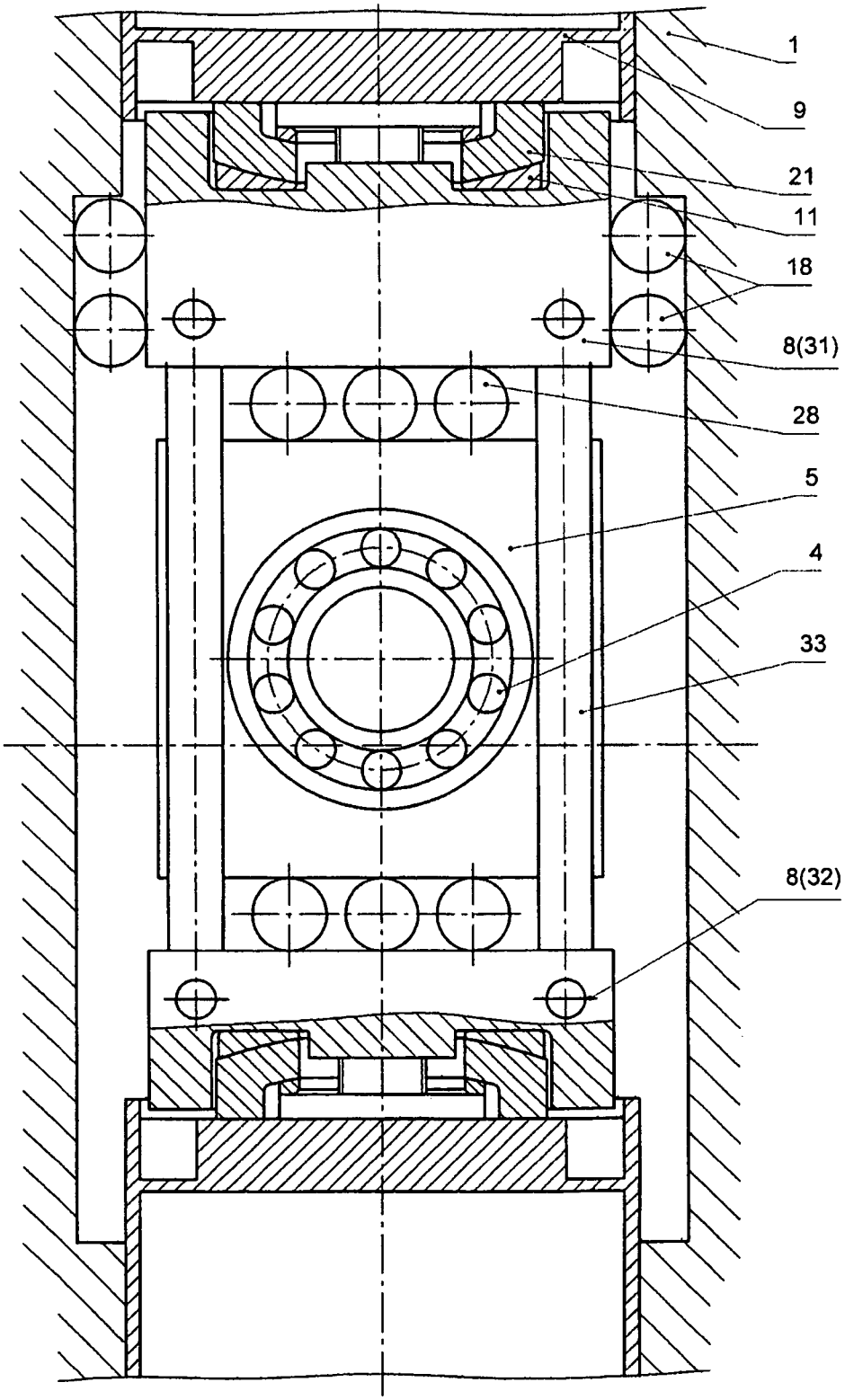
FIG. 4 shows the drawing of a machine with side rollers on one of the opposite parts of the machine.
Figure 5:
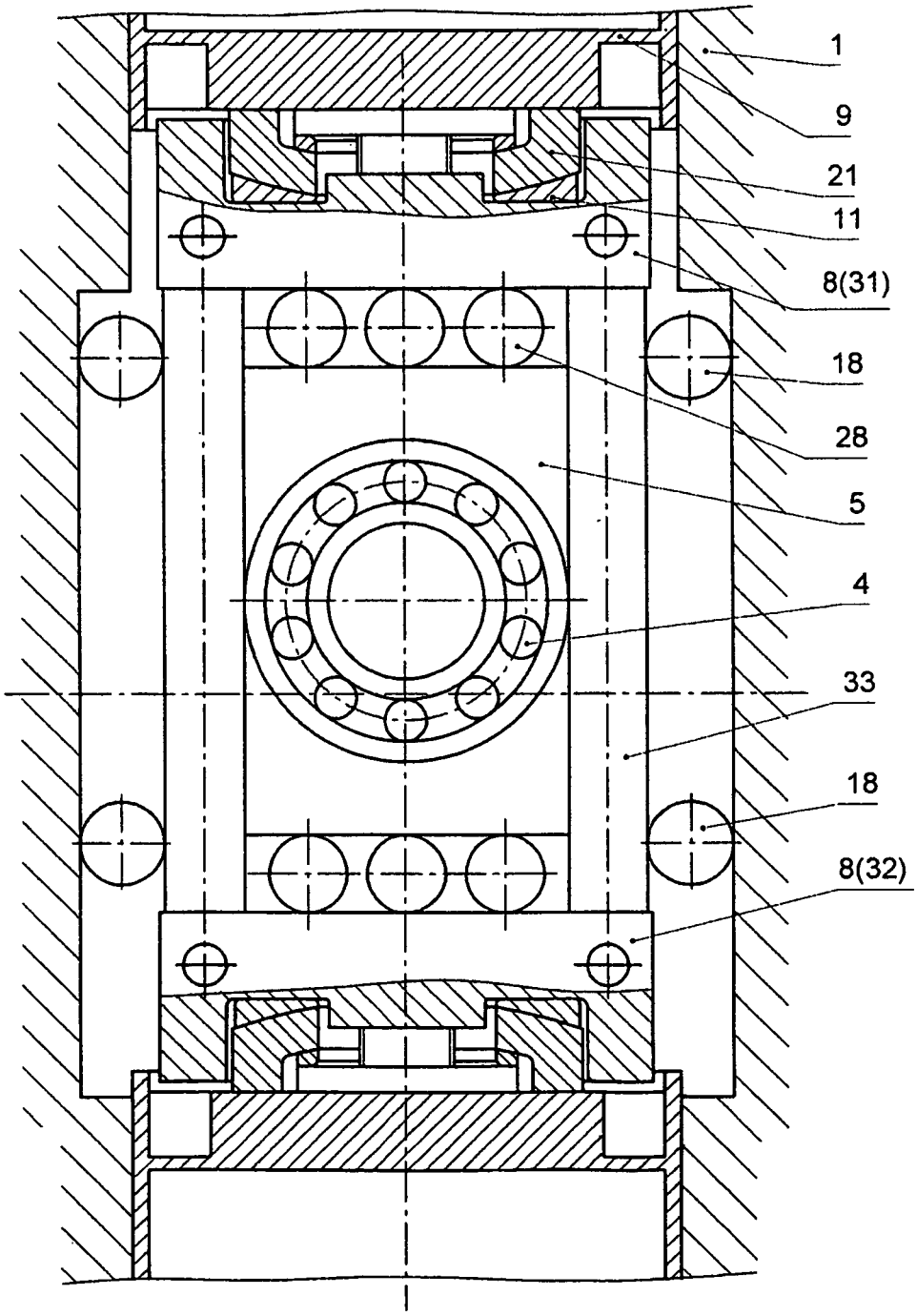
FIG. 5 shows the drawing of a machine with side rollers on the link connecting elements.
Figure 6:
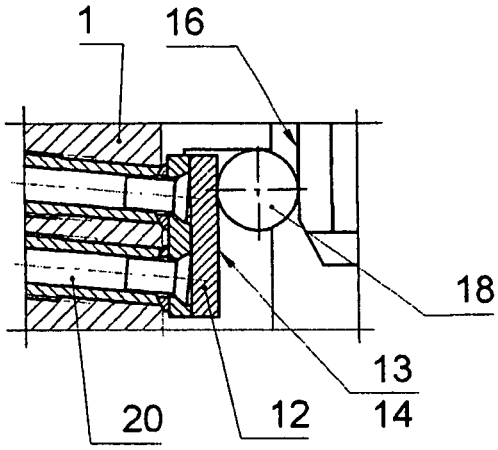
FIG. 6 shows a version of the mechanism for adjusting spatial position of the support elements.
Figure 7:
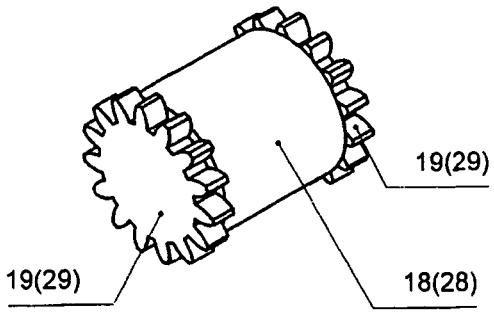
FIG. 7 shows appearance of rollers with synchronizing pinions.
Figure 8:
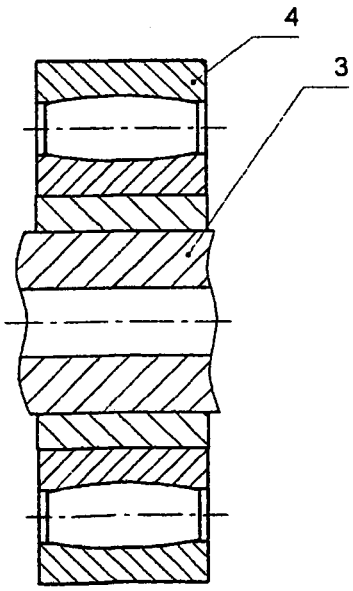
FIG. 8 shows the crankpin bearing assembly.
Figure 9:
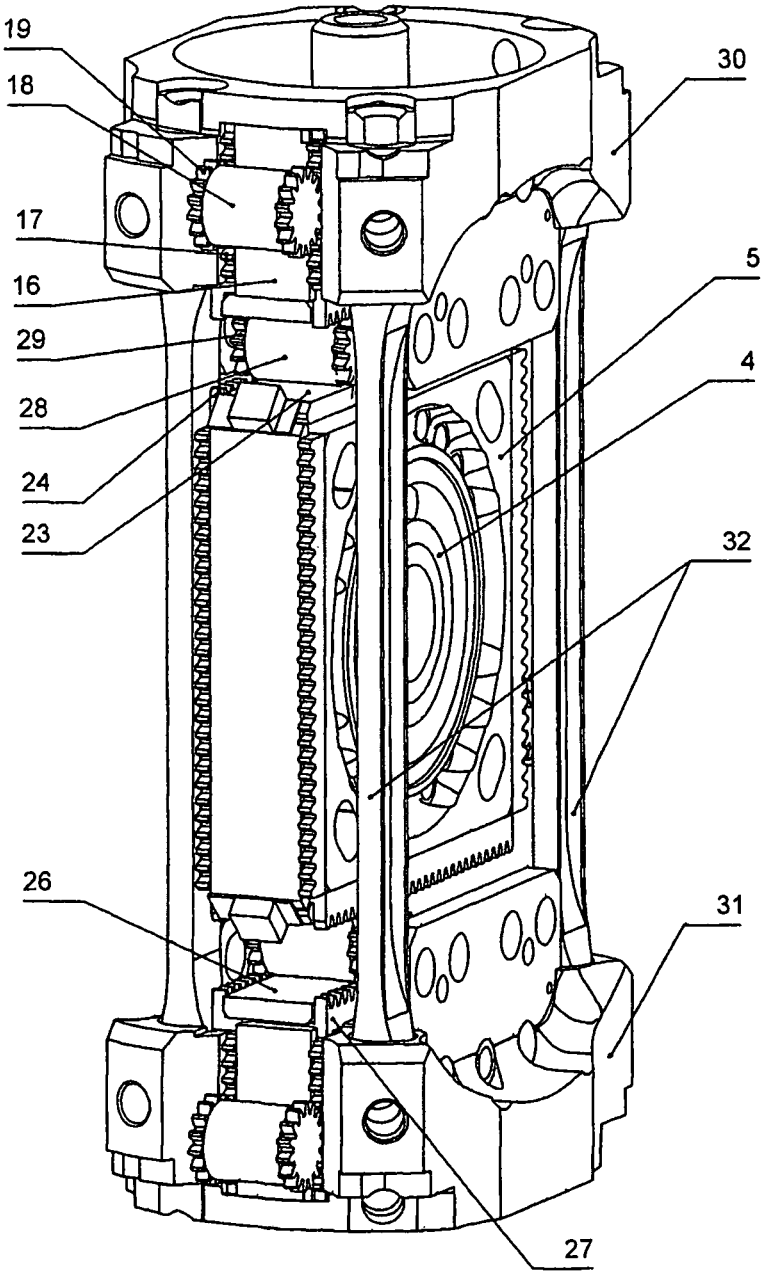
FIG. 9 shows a 3D view of the mechanism assembly.
Figure 10:
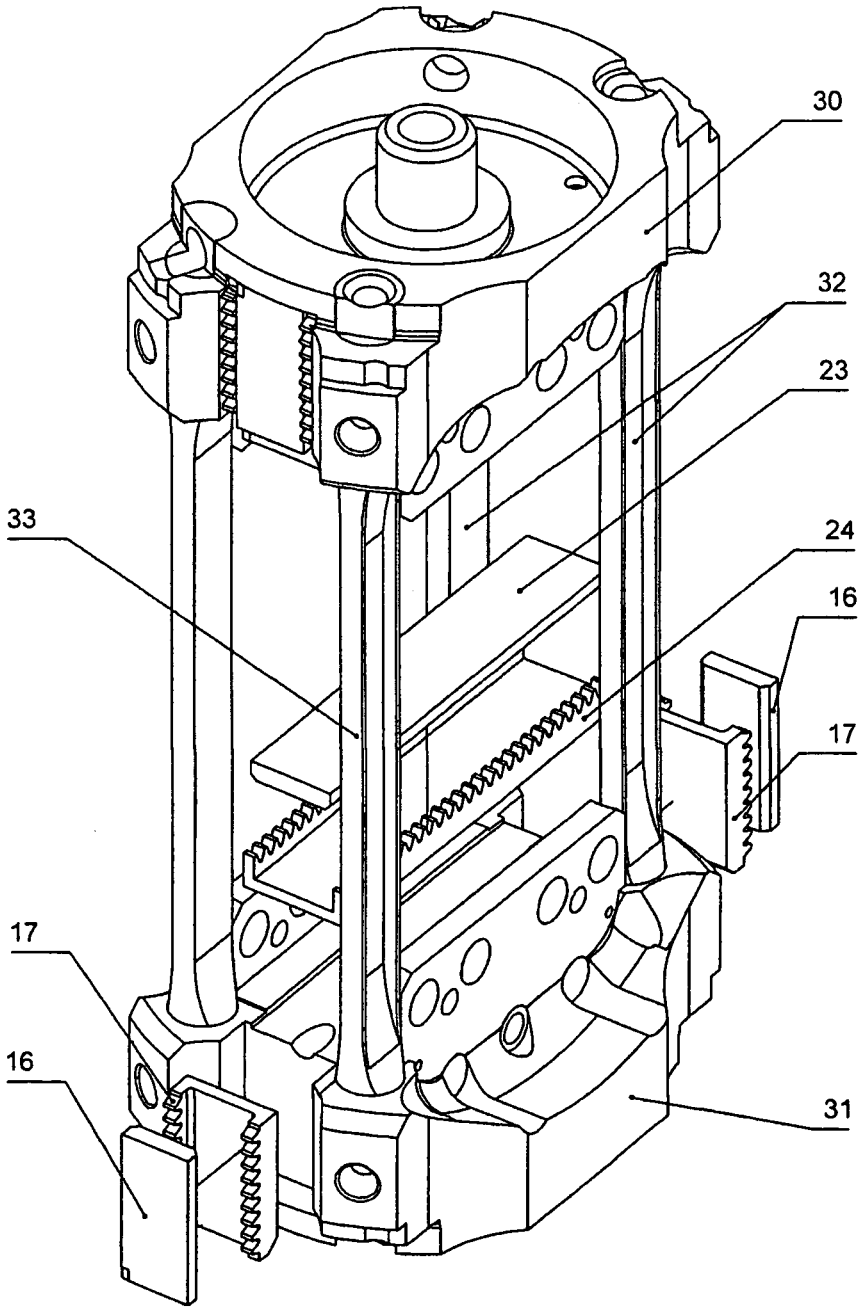
FIG. 10 shows the same, the mechanism with designation of components.

The crankshaft-link machine consists of case 1, which accommodates crankshaft 2 with crank 3, mounting, through bearing 4, slide block 5 (slider). Opposite work surfaces 7 and 8 of slide block 5 interact with the surfaces of link 8 coupled with piston 9 reciprocating in cylinder 10. Piston 9 and link 8 are interconnected by means of a hinge assembly with flat hinge 11, enabling piston 9 to self-align along the surface of cylinder 10. Radial clearance in hinge 11, made, for example, in the form of a bayonet connection, enables piston 9 to travel relative to link 8 in any direction in the plane crossing the longitudinal axis of cylinder 10. The surface of case 1 mounts support elements 12 with contact surfaces 13 and toothed racks 14, while the surfaces of link 8 mount support elements 15 with contact surfaces 16 and toothed racks 17. Accommodated in-between contact surfaces 13 and 16 are rollers 18 provided with synchronizing toothed wheels 19 engaged with toothed racks 14 and 17 of side support elements 15 and 15, which take up the reactive torque. Mounted on each side of link 8 in the plane of the reactive torque action are at least two rollers 18. Support elements, for example, 12, may be equipped with mechanism 20 to adjust the spatial position of elements 12 for creating at least a pre-interference in the interfacing contact surfaces 13 and 16 and rollers 18. Support elements 12 may be made with a guaranteed clearance between their contact surfaces 13 being less than the sum of two diameters of rollers 18 and the distance between contact surfaces 16. In this case, constriction is provided without employment of mechanism 20, however additional fixtures are required during the machine assembly.

The hinge assembly may be additionally provided with spherical bearing 21 enabling piston 9 to change the tilt angle of its longitudinal axis relative to the direction of link 8 reciprocation.

The surfaces of slide block 5 bear operating support elements 22 with contact surfaces 23 and toothed racks 24, and the surfaces of link 8 mount working support elements 25 with contact surfaces 26 and toothed racks 27. Therewith, accommodated between contact surfaces 23 and 26 of slide block 5 and link 8, respectively, are support rollers 28 equipped with synchronizing toothed wheels 29 engaged with racks 24 and 27. Thereat, the operating support element, for example, 25 incorporates mechanism 30 to adjust its spatial position for creating at least a pre-interference in the place where rollers 28 are engaged with contact surfaces 23 and 26 of operating support elements 22 and 25.

Link 8 may be made both in the form of an assembly, consisting of opposite parts 31 and 32 interconnected by connecting elements 33, and in the form of an integral part made as one piece with parts 12 and 13 and connecting elements 33.

The described machine operates as follows. Reciprocation of pistons 9 is converted into rotation of shaft 2 by means of a link mechanism comprising link 8 and slide block 5. Thereat, the assemblies with side support elements 12 and 15 take up the reactive torque occurring in the course of the machine operation. Since the action of the reactive torque is translated to case 1 exactly through link 8, the inner surface of cylinder 10 does not perform the power functions of translating the lateral loads to case 1, and piston 9 is self-aligned along cylinder 10 inner surface, irrespective of mechanical and thermal deformations of the whole mechanism and case 1 or accuracy of mechanism parts positioning relative to case 1. This solution is especially necessary if an adjustment assembly, for example, mechanism 20, is integrated into the structure, and in combination with bearing 4 used as a crankpin one and possessing certain degrees of freedom as to the rocking angle and in axial direction (SKF CARB toroidal bearings), it enables link 8 to occupy any spatial position relative to case 1 assigned to it during assembly, which also does not depend on deformations or accuracy of crankshaft 2 manufacture. The machine essentially comprises crankshaft 2 assembly, link 11 assembly interacting with case 1, and a cylinder-piston group assembly. Deformations of parts in each of the said assemblies or inaccuracy in their manufacture do not affect the character of interaction of elements in adjacent assemblies. And each assembly performs the functions it best suits.

As the length of contact surfaces of both operating and side support elements is minimal, the machine dimensions are also minimal in all directions. Essentially, in the course of the described machine operation slide block 5 in its extreme positions goes beyond the dimensions of operating support elements 25, passing in-between connecting elements 33. With the link mechanism designed this way, link 8 represents a spatial structure with maximum stiffness, which is capable of ensuring reliable operation of the movable interface at a minimum weight.

The capability of creating a pre-interference in the contact assemblies of link 8, slide block 5 and case 1 makes it possible to preclude impacts of rollers 18 and 28 against the respective contact surfaces, and to extend the machine life. Therewith, the interference value varies depending on the machine operating modes. The minimum pre-interference value during the machine assembly corresponds to the condition of taking up the clearance in the interface.

INDUSTRIAL APPLICABILITY

Thus, the described crankshaft-link piston machine provides the increased operational reliability, the extended life with optimized weight and size parameters and higher efficiency due to the prevention of manufacturing and mounting inaccuracies influence on the machine operation.

The excluding of the machine's reactive torque effect on the cylinder inner surface allows to achieve better uniformity of the circumferential forces distribution which improves the tightness of the machine's working chamber and its efficiency.

The invention claimed is:

1. A crank-and-rocker piston machine, comprising a case accommodating a crankshaft with at least one crank which mounts, through a bearing, a slide block (slider), where the opposite work surfaces of the slide block interact with the surfaces of the link coupled with at least one piston reciprocating inside a cylinder secured to the machine case, characterized in that the piston and link are interconnected by a hinge assembly incorporating, as a minimum, a flat hinge, which enables the piston to self-align along the cylinder surface due to its travel relative to the link in any direction in the plane crossing the cylinder longitudinal axis, while the interfacing surfaces of the link and case taking up the reactive torque mount side support elements with contact surfaces and toothed racks and the space between the contact surfaces of the side support elements accommodate rollers provided with synchronizing toothed wheels which are engaged with the toothed racks of the side support elements, where at least two rollers are mounted on each side of the link, therewith the support elements and rollers are installed with preliminary constriction of interfacing contact surfaces and rollers.

2. A machine of claim 1, wherein the hinge assembly is additionally equipped with a spherical hinge, enabling the piston to change the tilt angle of its longitudinal axis relative to the link reciprocation direction.

3. A machine of claim 1, wherein it contains a mechanism constraining the side support elements to create a pre-interference in the place where the rollers are engaged with the contact surfaces of the side support elements.

4. A machine of claim 1, wherein the support elements mounted on the case are equipped with an adjustment mechanism.

5. A machine of claim 1, wherein the interfacing surfaces of the slide block and link bear operating support elements with contact surfaces and toothed racks, while the space between the contact surfaces of the slide block and link accommodates support rollers provided with synchronizing toothed wheels which are engaged with the racks of the operating support elements of the link and slide block.

6. A machine of claim 5, wherein at least one operating support element may contain a mechanism for adjusting its spatial position to create at least a pre-interference in the place where the rollers are engaged with the contact surfaces of the operating support elements.

* * * * *